US005853356A

United States Patent [19]

David

[11] Patent Number: 5,853,356

[45] Date of Patent: Dec. 29, 1998

[54] EXERCISING APPARATUS

[75] Inventor: Henry B. David, Glendale, Calif.

[73] Assignee: Projects 2000, Inc., Los Angeles, Calif.

[21] Appl. No.: 991,333

[22] Filed: Dec. 15, 1997

[51] Int. Cl.[6] ..... A63B 21/02

[52] U.S. Cl. ..... 482/126; 482/122; 482/121

[58] Field of Search ..... 482/126; 24/196, 24/197

[56] References Cited

U.S. PATENT DOCUMENTS

| | | | |
|---|---|---|---|
| 83,381 | 10/1868 | Herbert | 24/196 |
| 1,832,633 | 11/1931 | Hendrickson, Jr. | 482/126 |
| 3,482,228 | 12/1969 | Curran | 24/196 |

*Primary Examiner*—Lynne A. Reichard
*Attorney, Agent, or Firm*—Michael A. Painter

[57] ABSTRACT

The present invention comprises a pair of gripping handles between which a planar elastic band is supported. The coupling between each handle and the elastic band prevents inadvertent disengagement of the handle from the end of the elastic band and provides means for adjusting the distance between the handles and the force exerted. The end of the elastic band is directly supported by the end flange of the handle. A suspension clip having a bracing member extending parallel to the end flange is adapted to be removably disposed upon the end flange of the handle. A locking link having a central slot is adapted to be disposed adjacent the end flange in juxtaposition to the suspension clip. The end of the elastic band is threaded through the central slot of the locking link disposed about the bracing member of the suspension clip and threaded back through the central slot of the locking link. The force exerted by the elastic band upon the suspension clip, locking link and end flange prevent inadvertent movement of the elastic and relative to the handle.

4 Claims, 2 Drawing Sheets

EXERCISING APPARATUS

BACKGROUND OF THE INVENTION

1. Field of the Invention

The present invention generally relates to exercisers used for exercising the muscles of the back, chest, shoulders and the like, and more particularly, to exercisers employing a pair of handle having an elastic band stretched therebetween to generate the exercising force.

2. Prior Art

In recent years, exercising devices employing elastic bands or other means for imposing a resilient force have become a popular and useful means to exercise upper body muscle groups. The users of such devices not only include professional and college athletes who may use such devices for building strength and for physical conditioning, they are used for all persons to maintain muscle tone. The prior art discloses numerous devices which suspend an elastic band between a pair of handles which are adapted to be stretched or otherwise pulled by the user in order to generate opposing force. The devices disclosed by the prior art have inherent problems relating to inadvertent dislodgment of the elastic band from the handles or difficulty in adjusting the length of the elastic bands and the opposing force imposed upon the handle. This problem is caused by the manner in which the elastic band is secured to the handle.

The devices taught by the prior art employ variations on two general coupling methods. In one class of exercising devices taught by the prior art, the ends of the elastic band depend into a bead or protuberance which are used to secure the band to a supporting hook or the like. When the band is stretched and force is imposed, the bead or protuberance may be inadvertently dislodged or even mutilated by the separation of the band from the bead.

In another device taught by the prior art, the elastic band is disposed between an adjustable pin and a clamping surface. The elastic band will remain in place only when the force imposed by the adjustable pin in the direction of the clamping surface is sufficient to secure the elastic band therebetween. The problems in this device are inherent in the manner in which the clamping forces are imposed. Unless the clamping force is sufficient, the band will be dislodged. If the force is excessive, the elastic band can be damaged. In addition to the problem of inadvertent slippage, adjusting the length of the band and the force imposed to suit the user is cumbersome, difficult and inaccurate.

The present invention resolves those problems inherent in those devices taught by the prior art. Each of the two handles extends into end flanges which are adapted to be oriented parallel to each other. An elastic band is secured to the end flange of a handle through the use of a suspension clip and a locking link. The suspension clip is adapted to be disposed about the end flange of the handle. The locking clip includes an interior or central slot which is adapted to be disposed in juxtaposition to the suspension clip and lie in parallel spaced relation to the end flange. The end of the elastic band is directed through the slot of the locking link, disposed about a center brace of the suspension clip and directed back through the slot of the locking link. When opposing forces are directed on the handles, the suspension clip and locking link will secure the position of the elastic band adjacent the end flange preventing inadvertent movement. An adjustment of the length of the elastic band is accomplished merely by slidably removing the suspension clip from the end flange and reinserting the elastic band to the desired length.

SUMMARY OF THE INVENTION

The present invention comprises an exercising device employing a pair of opposed handles to be gripped by the user. A resilient, elastic band is disposed between the handles to generate the exercising force. Each of the handles generally consists of a gripping cylinder adapted to fit and be held within the hands of the user and extending into an end flange which is in parallel spaced relation to the gripping cylinder. The end of a planar, elastic band is adapted to be secured to the end flange. The end of the elastic band is secured to the end flange through the use of a suspension clip and a cooperating locking link. The suspension clip consists of a linear bracing member substantially equivalent in length to the end flange. Each end of the suspension clip is bent into a substantially U-shaped form adapting the suspension clip to be removeably disposed upon the handle in parallel spaced relation to the end flange. An enclosed locking clip includes a central slot adapted to receive an end of the elastic band. The end of the elastic band is threaded through the central slot of the locking clip, disposed about the bracing member of the suspension clip and then threaded back through the central slot. When force is imposed upon the elastic band in opposition to the handle, the suspension clip and locking link will be forced adjacent the end flange securing the position of the elastic band therebetween.

It is an object of the present invention to provide an improved exercising apparatus.

It is another object of the present invention to provide an improved exercising apparatus incorporating an elastic band for imposing an exercising force.

It is still another object of the present invention to provide an exercising device which may be adjusted to the user's reach and the desired tension.

It is still yet another object of the present invention to provide an improved exercising device which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
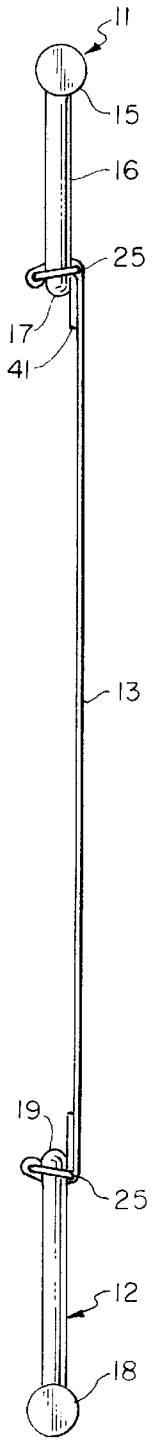
FIG. 1 is a side elevation view of the present invention exercising apparatus.

Referring now to FIG. 1, an exercising apparatus in accordance with the present invention can be best seen, the exercising apparatus being generally designated by the reference numeral 10. Exercising apparatus 10 comprises a pair of user handles 11 and 12 between which is mounted a resilient, planar elastic strip or band 13. When elastic band 13 is stretched, it will generate opposed exercising forces on handles 11 and 12.

Figure 2:
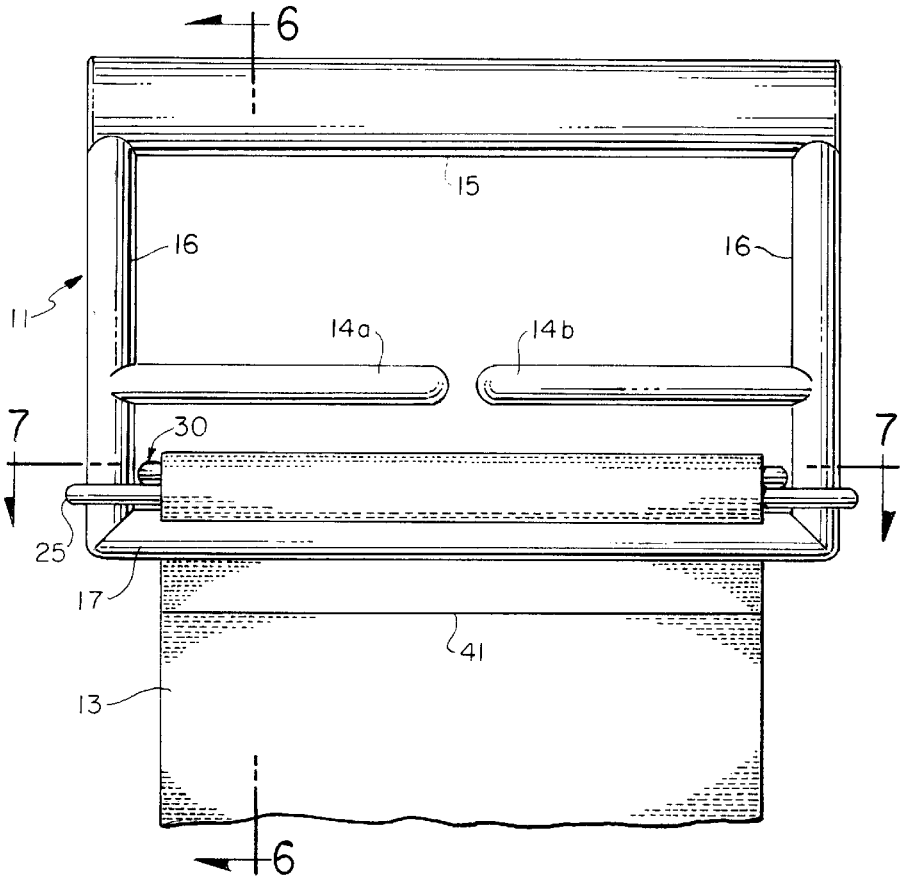
FIG. 2 is a top plan view of the coupling between a handle and the end of a planar, elastic band in accordance with the present invention.

Referring now to FIG. 2, the structure of gripping handle 11 can be best seen. A gripping cylinder 15 adapted to be held in the hand of a user extends into a pair of parallel supporting legs 16. End flange 17 is integral with the pair of supporting legs 16 in opposition to gripping cylinder 15, and is disposed in parallel, spaced relation to gripping cylinder 15. In a like manner, user handle 12 includes a gripping cylinder 18 and an end flange 19 which is in parallel spaced relation thereto. Guard members 14*a* and 14*b* are integral with a respective one of said supporting legs 16 and extend inwardly in axial opposition to each other. Guard members 14*a* and 14*b* are separated to aid the insertion of elastic strip 13 and prevent the user's hand from coming into inadvertent contact with elastic band 13 while the present invention is in use.

Figure 3:
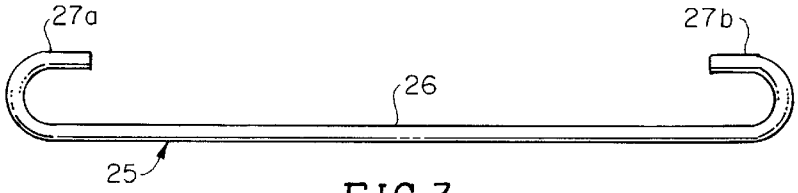
FIG. 3 is a side elevation view of the suspension clip shown in FIG. 2.
Figure 4:
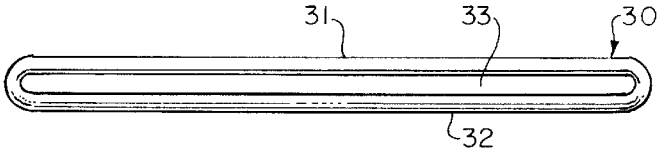
FIG. 4 is a side elevation view of the locking link shown in FIG. 2.
Figure 7:
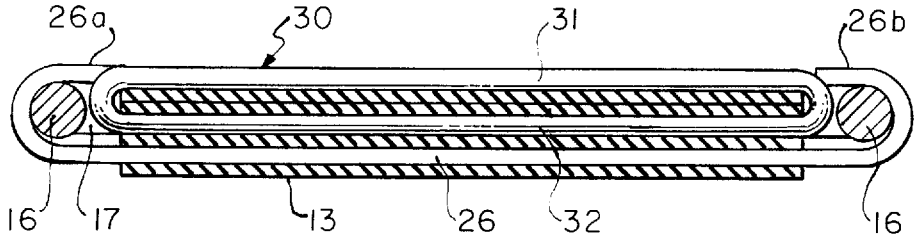
FIG. 7 is a cross-sectional view of the exercising apparatus handle taken through line 7—7 of FIG. 2.

As stated hereinabove, it is an objective of the present invention to provide a coupling between the user handles 11 and 12 and elastic band 13 which will permit adjustment of the distance between handles 11 and 12 and/or the tension or exercising force imposed by elastic band 13. The elements used to couple elastic band 13 to handles 11 and 12 can be best seen in FIGS. 3, 4 and 7. As shown in FIG. 7, a suspension clip 25 is adapted to be disposed about the support legs 16 of handle 11. Suspension clip 25 consists of a linear bracing member 26, each end of which is bent into a substantially U-shaped form thereby creating positioning guides 27*a* and 27*b*. The second member necessary to couple the elastic band 13 to the user handle 11 and 12 is locking link 30 (FIG. 4). Locking link 30 comprises an enclosed structure having a pair of band guides 31 and 32 integral at the ends thereof. Band guides 31 and 32 define a central, elongated slot 33 therebetween which is adapted to receive elastic band 13 in the manner to be described in detail hereinbelow. As can be seen best in FIG. 7, locking link 30 is adapted to be positioned adjacent end flange 17 intermediate supporting legs 16.

Figure 5:
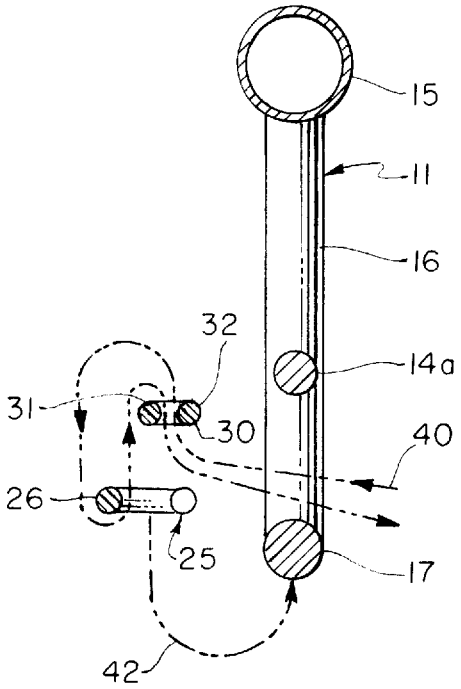
FIG. 5 is a schematic, cross-sectional illustration of the coupling between the planar elastic band, the suspension clip, locking link and handle in accordance with the present invention.

The coupling between an end of elastic band 13 and handles 11 and 12 can be best seen by reference to FIG. 5. Elastic band 13 is coupled to end flange 17 by properly threading elastic band 13 through locking link 30 about bracing member 26 and, most importantly, the positioning of suspension clip 25 upon end flange 26. Referring now to FIG. 5, the threading orientation of elastic band 13 is generally designated by the reference number 40. An end 41 of elastic band 13 which is to be coupled to handle 11 is threaded in the manner directed by reference numeral 40. End 41 is disposed through central slot 33 between band guides 31 and 32, disposed about bracing member 26 and threaded back through central slot 33 so that it lies adjacent the extended portion of elastic band 13. To secure elastic band 13 in place, suspension clip 25 is disposed about supporting legs 16 adjacent end flange 17 in the manner identified by reference numeral 42 (FIG. 5).

Figure 6:
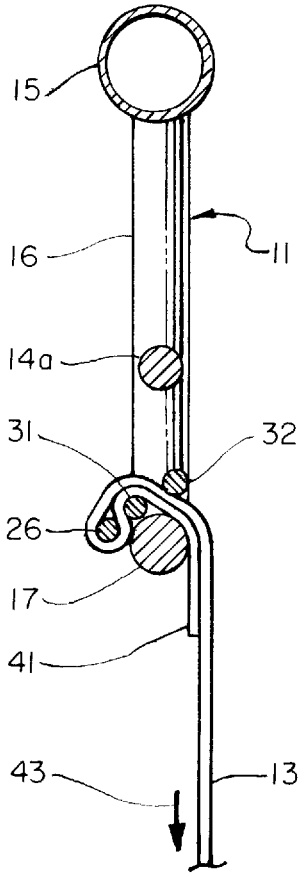
FIG. 6 is a cross-sectional view of the coupled planar, elastic band shown in FIG. 2 taken through lines 6—6 of FIG. 2.

When force is imposed on elastic band 13 in the direction designated by reference numeral 43 (FIG. 6), end 41 of elastic band 13 will be urged against end flange 17 in the manner shown in FIG. 6. Since suspension clip 25 is secured about end flange 17, the resilient force created by elastic band 13 will force locking clip 30 toward end flange 17 securing clamping elastic band 13 against end flange 17 thereby preventing inadvertent slippage. The distance between handles 11 and 12 and the force imposed by elastic band 13 can be adjusted merely by changing the position of end 41 relative to the remainder of elastic band 13.

I claim:

1. An exercising apparatus comprising:

(a) first and second gripping handles, each of said gripping handles including a gripping cylinder having supporting legs extending therefrom in parallel spaced relation to each other and an end flange secured to said supporting legs in parallel spaced relation to said gripping cylinder;

(b) guard members extending inwardly from said supporting legs in axial abutment with one another separating the gripping handles from said end flange;

(c) a suspension clip disposed upon said supporting legs adjacent said end flange including a linear bracing member adapted to be adjacent said end flange and in parallel spaced relation thereto;

(d) a locking link having a central slot; and (e) a planar, elastic band having first and second ends coupled to the first and second gripping handles respectively, each end being disposed through the central slot of said connecting link and about the bracing member of said suspension clip securing the end of said elastic band against the end flange.

2. An exercising apparatus as defined in claim 1 wherein the end of said elastic band is moveable through the central slot of said connecting link whereby the distance between the gripping handles may be adjusted.

3. An exercising apparatus comprising:

(a) first and second gripping handles, each of said gripping handles including a gripping cylinder having first and second supporting legs extending therefrom in parallel spaced relation to each other and an end flange secured between said first and second supporting legs in parallel, spaced relation to said gripping cylinder;

(b) guard members extending inwardly from said supporting legs in axial abutment with one another separating the gripping handles from said end flange;

(c) a suspension clip having a linear bracing member having first and second ends and being adapted to be adjacent said end flange and in parallel spaced relation thereto, said first and second ends each extending into opposed positioning guides, said positioning guides being disposed about said first and second supporting legs respectively;

(d) a locking clip having first and second band guides in parallel spaced relation to each other defining a central slot therebetween; and (e) a planar, elastic band having first and second ends coupled to the first and second gripping handles respectively, each end being disposed between said first and second band guides and about the bracing member of said suspension clip securing the end of said elastic band against the end flange.

4. An exercising apparatus as defined in claim 3 wherein the end of said elastic band is moveable between said first and second band guides and through the central slot of said connecting link whereby the distance between the gripping handles may be adjusted.

* * * * *